US012291767B2

(12) United States Patent
Krishnan et al.

(10) Patent No.: US 12,291,767 B2
(45) Date of Patent: May 6, 2025

(54) HIGH STRENGTH STAINLESS STEEL MATERIAL

(71) Applicant: Halliburton Energy Services, Inc., Houston, TX (US)

(72) Inventors: Karthik Krishnan, Little Elm, TX (US); Chad W. Glaesman, Singapore (SG); Arpana Singh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/727,418

(22) Filed: Apr. 22, 2022

(65) Prior Publication Data

US 2023/0059069 A1 Feb. 23, 2023

Related U.S. Application Data

(60) Provisional application No. 63/230,203, filed on Aug. 6, 2021.

(51) Int. Cl.

| | |
|---|---|
| ***C22C 38/40*** | (2006.01) |
| ***C21C 5/00*** | (2006.01) |
| ***C21D 6/00*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/16*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/50* (2013.01); *C21C 5/005* (2013.01); *C21D 6/004* (2013.01); *C21D 9/00* (2013.01); *C22C 38/002* (2013.01); *C22C 38/02* (2013.01); *C22C 38/04* (2013.01); *C22C 38/12* (2013.01); *C22C 38/16* (2013.01); *C22C 38/40* (2013.01); *C22C 38/44* (2013.01); *C22C 38/46* (2013.01); *C22C 38/48* (2013.01)

(58) Field of Classification Search

CPC ..... C22C 38/40

See application file for complete search history.

(56) References Cited

U.S. PATENT DOCUMENTS

| | | | | |
|---|---|---|---|---|
| 4,689,198 | A | 8/1987 | Fujiwara et al. | |
| 2006/0034724 | A1 | 2/2006 | Hamano et al. | |
| 2008/0073005 | A1 | 3/2008 | Buck | |
| 2020/0002793 | A1 | 1/2020 | Teraoka et al. | |
| 2020/0270718 | A1 * | 8/2020 | Santacreu | C22C 38/54 |

FOREIGN PATENT DOCUMENTS

| | | | | |
|---|---|---|---|---|
| CN | 109881123 | | 6/2021 | |
| JP | 3342501 | B2 | 11/2002 | |
| JP | 2008297602 | A * | 12/2008 | C21D 1/25 |
| WO | WO-2019086934 | A1 * | 5/2019 | C21D 1/25 |

OTHER PUBLICATIONS

English machine translation of JP 2008297602 A of Kimura (Year: 2008).*

Chan et al., "Effect of retained austenite on the hydrogen content and effective diffusivity of martensitic structur", Metallurgical Transactions A, vol. 22, Nov. 1991, 2579-2586.

Kulkarni, "Improvement in mechanical properties of 13Cr Martensitic Stainless Steels using modified heat treatments", Proceedings of the 28th ASM Heat Treating Society Conference, Detroit, Michigan, Oct. 20-22, 2015, pp. 335-341.

Mithieux et al., "Influence of Nb Addition on Impact Toughness of As-Quenched Martensitic Stainless Steel for Automotive Applications", Materials Science Forum, vol. 941, 2018, 245-250.

Solheim, "The role of retained austenite in hydrogen embrittlement of supermartensitic stainless steel", Engineering Failure Analysis, vol. 34, 2013, pp. 140-149.

International Application, International Search Report and Written Opinion, PCT/US2022/026008, Aug. 3, 2022, 12 pages.

* cited by examiner

*Primary Examiner* — Jophy S. Koshy

(74) *Attorney, Agent, or Firm* — Halliburton Energy Services, Inc.

(57) ABSTRACT

Methods for improving a toughness and a strength of a stainless steel material are described herein. For example, a high strength stainless steel material can comprise at least 11 wt. % Cr, between 0.01 wt. % and 1.0 wt. % Ni, more 0 wt. % Mo, more than 0 wt. % W, more than 0 wt. % Ti, more than 0 wt. % Nb, and more than 0 wt. % V. In some examples, the high strength stainless steel material can be heat treated with at least one quench treatment and at least one tempering heat treatment. In some examples, the high strength stainless steel material can comprise between 0.01 wt. % and 0.5 wt. % Ni, no more than 0.25 wt. % Mo, no more than 0.1 wt. % W, no more than 0.1 wt. % Ti, no more than 0.1 wt. % Nb, and no more than 0.1 wt. % V.

15 Claims, 3 Drawing Sheets

HIGH STRENGTH STAINLESS STEEL MATERIAL

CROSS REFERENCE TO RELATED APPLICATIONS

This application claims priority to U.S. Patent Application No. 63/230,203 filed Aug. 6, 2021, which is incorporated herein by reference in its entirety.

TECHNICAL FIELD

The present disclosure relates generally to wellbore completion operations and, more particularly (although not necessarily exclusively), to the use of a high strength stainless steel material in wellbore completion operations.

BACKGROUND

Hydrocarbons, such as oil and gas, can be extracted from subterranean formations that may be located onshore or offshore. The hydrocarbons can be extracted through a wellbore formed in the subterranean formation. Wellbore operations for extracting the hydrocarbons can include drilling operations, completion operations, and production operations. Some or all of these wellbore operations may involve wellbore tools that may be exposed to corrosive or otherwise detrimental fluids in the wellbore, such as hydrogen sulfide. In many instances, such wellbore tools are composed of stainless steel alloys, such as austenitic stainless steel alloys and martensitic stainless steel alloys. Martensitic stainless steel alloys typically do not include nickel and exhibit relatively high strength but low ductility and corrosion resistance. Austenitic stainless steel alloys typically include relatively high amounts of nickel and exhibit relatively low strength but high ductility and corrosion resistance. Stainless steel alloys, particularly martensitic stainless steel alloys, may be susceptible to sulfide stress cracking in the presence of hydrogen sulfide.

DETAILED DESCRIPTION

Figure 1:
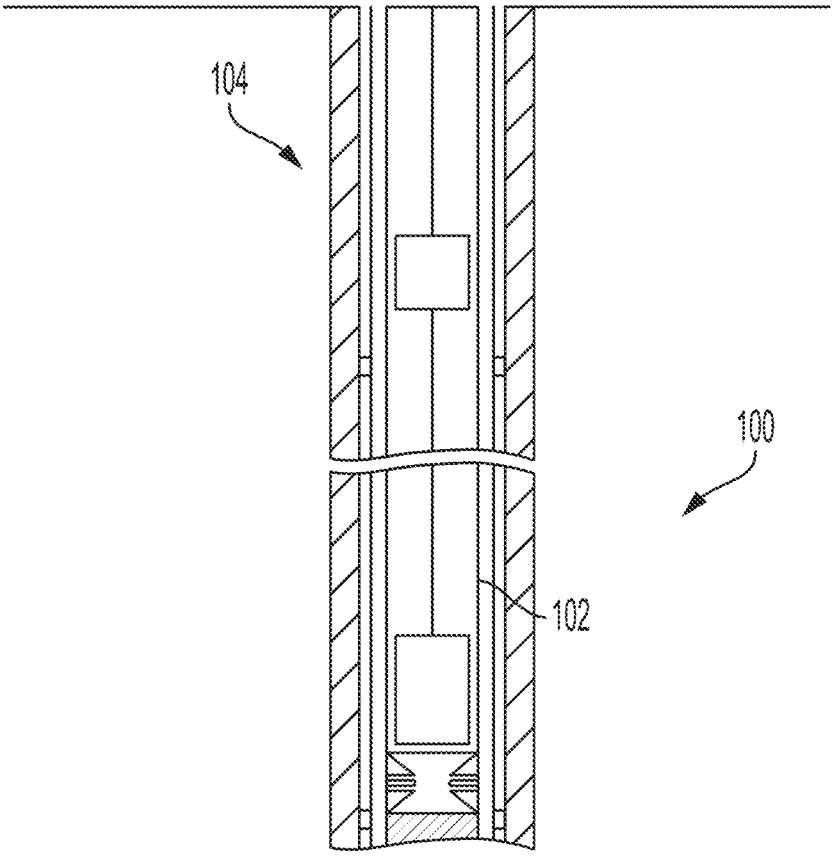
FIG. 1 is a schematic of a well system including a well tool according to one example of the present disclosure.

Certain aspects and examples of the present disclosure relate to improving the toughness of a 13Cr type martensitic stainless steel material, herein referred to as a 13Cr material, at higher yield strengths for use in a wellbore operation without changing the core microstructure of the 13Cr material. The 13Cr material may be used in materials and tools in a downhole environment, for example in tools used at the completion stage of a wellbore. The toughness of the 13Cr material may be improved by alloying the stainless steel material with relatively low amounts of Ni, Mo, W, Ti, Nb, and V, and austenitizing the 13Cr material while primarily retaining its martensitic microstructure.

Stainless steels with strength levels of 95/105/110/125 ksi Minimum Yield Strength (MY) having both adequate toughness and significant hydrogen sulfide ($H_2S$) resistance for use in downhole oil and gas production environment are desirable. Such a material can provide a more economical solution than alternate grades, such as nickel alloys, in the presence of $H_2S$ to ensure safe use and prevention of environmental cracking. For example, $H_2S$ may cause wellbore tools composed of such materials to experience sulfide stress cracking (SSC). Currently, 13Cr materials are known to have favorable resistance at strengths of 80 ksi MY. Heat treating this grade to higher strengths such as 95/105/110/125 ksi MY can result in reduced toughness, which is not currently considered acceptable for service requiring environmental cracking resistance in presence of $H_2S$. By modifying the chemistry of 13Cr materials, without changing the core microstructure, a stainless steel material having adequate toughness and stress cracking resistance for use downhole can be created.

Typically, 13Cr materials can have very little retained austenite due to very low Ni content. This is in contrast to other grades of stainless steel, where the intentional addition of Ni, such as over 1 wt. %, can lead to a metastable austenite-martensite stainless steel material or a Super 13Cr martensitic stainless steel material. Such grades of stainless steel may have microstructures exhibiting both martensite and retained or reverted austenite, approximately 5 wt. % Ni, and in some cases N. Notably, Super 13Cr martensitic stainless steel materials may not have a higher toughness than 13Cr materials.

To improve the toughness of 13Cr materials, Mo, W, Ti, Nb, and V can be added to the 13Cr material. Additionally, treatments comprising single or double austenitizing treatments, single or double quenching treatments, and single or double heat tempering treatments, can further refine the microstructure of the 13Cr material to be mainly martensitic. The improved 13Cr materials can then exhibit increased toughness at the higher strength levels of 95/105/110/125 ksi MY. The refined microstructure would additionally provide better SSC resistance as compared to Super 13Cr martensitic stainless steel materials for use in downhole operations.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 including a well tool according to one example of the present disclosure. As shown in FIG. 1, the well tool can be a completion string 102. During the completion stage of a wellbore, a completion string 102, can be positioned within a wellbore 104. The wellbore 104 can be formed below a surface 106 in a subterranean formation. The completion string 102 may comprise a 13Cr material formed according to aspects of the present disclosure for improving toughness and environmental cracking resistance at higher strengths. Additional tools may be used during the completion stage and one or more of those additional tools may comprise the 13Cr material formed according to aspects of the present disclosure.

Figure 2:
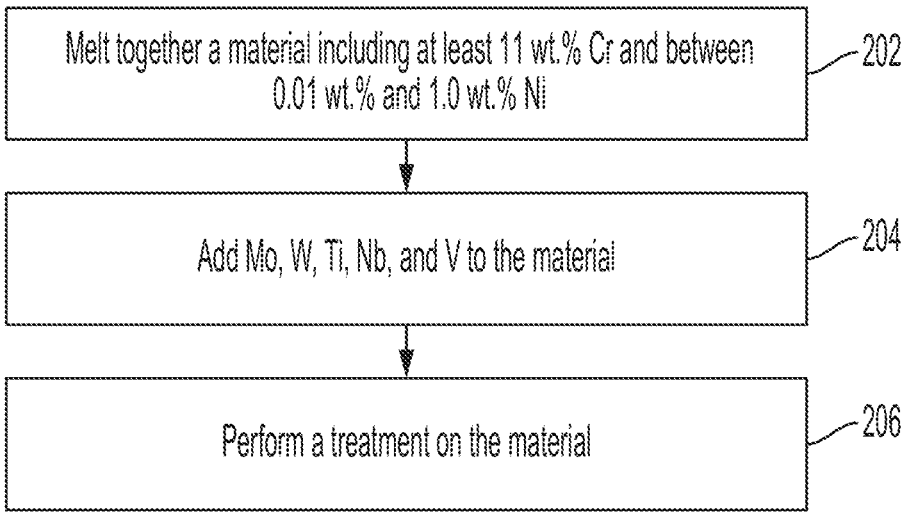
FIG. 2 is a flowchart of a method for improving a toughness of a 13Cr material according to one example of the present disclosure.

FIG. 2 is a flowchart of a method for improving a toughness of a 13Cr material according to one example of the present disclosure. At block 302, a 13Cr material including at least 11 wt. % Cr and between 0.01 wt. % and 0.5 wt. % (e.g., from about 0.05 wt. % to about 0.5 wt. %, from about 0.10 wt. % to about 0.5 wt. %, from about 0.15 wt. % to about 0.5 wt. %, from about 0.20 wt. % to about 0.5 wt. %, from about 0.25 wt. % to about 0.5 wt. %, from about 0.30 wt. % to about 0.5 wt. %, from about 0.35 wt. % to about 0.5 wt. %, from about 0.40 wt. % to about 0.5 wt. %, from about 0.45 wt. % to about 0.5 wt. %, from about 0.01 wt. % to about 0.4 wt. %, from about 0.05 wt. % to about 0.4 wt. %, from about 0.10 wt. % to about 0.4 wt. %, from about 0.15 wt. % to about 0.4 wt. %, from about 0.20 wt. % to about 0.4 wt. %, from about 0.25 wt. % to about 0.4 wt. %, from about 0.30 wt. % to about 0.4 wt. %, from about 0.35 wt. % to about 0.4 wt. %, from about 0.01 wt. % to about 0.3 wt. %, from about 0.05 to about 0.3 wt. %, from about 0.10 to about 0.3 wt. %, from about 0.15 to about 0.3 wt. %, from about 0.20 to about 0.3 wt. %, from about 0.25 to about 0.3 wt. %, from about 0.01 wt. % to about 0.2 wt. %, from about 0.05 wt. % to about 0.2 wt. %, from about 0.10 wt. % to about 0.2 wt. %, from about 0.15 wt. % to about 0.2 wt. %, from about 0.01 wt. % to about 0.1 wt. %, or from about 0.05 wt. % to about 0.1 wt. %) Ni is melted together. For example, the material can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.30 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, or 0.50 wt. % Ni. The relatively low presence of Ni may increase the toughness of the 13Cr material without significantly impacting the martensitic microstructure of the 13Cr material.

At block 204, Mo, W, Ti, Nb, and V are added to the 13Cr material. Each of Mo, W, Ti, Nb, and V can be added in an amount greater than 0 wt. %. In some examples, no more than 0.25 wt. % (e.g., from about 0.01 wt. % to about 0.25 wt. %, from about 0.05 wt. % to about 0.25 wt. %, from about 0.10 wt. % to about 0.25 wt. %, from about 0.15 wt. % to about 0.25 wt. %, from about 0.20 wt. % to about 0.25 wt. %, from about 0.01 wt. % to about 0.20 wt. %, from about 0.05 wt. % to about 0.20 wt. %, from about 0.10 wt. % to about 0.20 wt. %, from about 0.15 wt. % to about 0.20 wt. %, from about 0.01 wt. % to 0.15 wt. %, from about 0.05 wt. % to 0.15 wt. %, from about 0.10 wt. % to 0.15 wt. %, from about 0.01 wt. % to about 0.10 wt. %, or from about 0.05 to about 0.10 wt. %) Mo may be added. For example, the 13Cr material may include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, or 0.25 wt. % Mo.

In some examples, no more than 0.1 wt. % W (e.g., from about 0.01 wt. % to about 0.1 wt. %, from about 0.02 wt. % to about 0.1 wt. %, from about 0.03 wt. % to about 0.1 wt. %, from about 0.04 wt. % to about 0.1 wt. %, from about 0.05 wt. % to about 0.1 wt. %, from about 0.06 wt. % to about 0.1 wt. %, from about 0.07 wt. % to about 0.1 wt. %, from about 0.08 wt. % to about 0.1 wt. %, from about 0.09 wt. % to about 0.1 wt. %, from about 0.01 wt. % to about 0.09 wt. %, from about 0.02 wt. % to about 0.09 wt. %, from about 0.03 wt. % to about 0.09 wt. %, from about 0.04 wt. % to about 0.09 wt. %, from about 0.05 wt. % to about 0.09 wt. %, from about 0.06 wt. % to about 0.09 wt. %, from about 0.07 wt. % to about 0.09 wt. %, from about 0.08 wt. % to about 0.09 wt. %, from about 0.01 wt. % to about 0.08 wt. %, from about 0.02 wt. % to about 0.08 wt. %, from about 0.03 wt. % to about 0.08 wt. %, from about 0.04 wt. % to about 0.08 wt. %, from about 0.05 wt. % to about 0.08 wt. %, from about 0.06 wt. % to about 0.08 wt. %, from about 0.07 wt. % to about 0.08 wt. %, from about 0.01 wt. % to about 0.07 wt. %, from about 0.02 wt. % to about 0.07 wt. %, from about 0.03 wt. % to about 0.07 wt. % from about 0.04 wt. % to about 0.07 wt. %, from about 0.05 wt. % to about 0.07 wt. %, or from about 0.06 wt. % to about 0.07 wt. %) may be added. For example, the 13Cr material may include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, or 0.1 wt. % W.

In some examples, no more than 0.1 wt. % Ti (e.g., from about 0.01 wt. % to about 0.1 wt. %, from about 0.02 wt. % to about 0.1 wt. %, from about 0.03 wt. % to about 0.1 wt. %, from about 0.04 wt. % to about 0.1 wt. %, from about 0.05 wt. % to about 0.1 wt. %, from about 0.06 wt. % to about 0.1 wt. %, from about 0.07 wt. % to about 0.1 wt. %, from about 0.08 wt. % to about 0.1 wt. %, from about 0.09 wt. % to about 0.1 wt. %, from about 0.01 wt. % to about 0.09 wt. %, from about 0.02 wt. % to about 0.09 wt. %, from about 0.03 wt. % to about 0.09 wt. %, from about 0.04 wt. % to about 0.09 wt. %, from about 0.05 wt. % to about 0.09 wt. %, from about 0.06 wt. % to about 0.09 wt. %, from about 0.07 wt. % to about 0.09 wt. %, from about 0.08 wt. % to about 0.09 wt. %, from about 0.01 wt. % to about 0.08 wt. %, from about 0.02 wt. % to about 0.08 wt. %, from about 0.03 wt. % to about 0.08 wt. %, from about 0.04 wt. % to about 0.08 wt. %, from about 0.05 wt. % to about 0.08 wt. %, from about 0.06 wt. % to about 0.08 wt. %, from about 0.07 wt. % to about 0.08 wt. %, from about 0.01 wt. % to about 0.07 wt. %, from about 0.02 wt. % to about 0.07 wt. %, from about 0.03 wt. % to about 0.07 wt. % from about 0.04 wt. % to about 0.07 wt. %, from about 0.05 wt. % to about 0.07 wt. %, or from about 0.06 wt. % to about 0.07 wt. %) may be added. For example, the 13Cr material may include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, or 0.1 wt. % Ti.

In some examples, no more than 0.1 wt. % Nb (e.g., from about 0.01 wt. % to about 0.1 wt. %, from about 0.02 wt. % to about 0.1 wt. %, from about 0.03 wt. % to about 0.1 wt. %, from about 0.04 wt. % to about 0.1 wt. %, from about 0.05 wt. % to about 0.1 wt. %, from about 0.06 wt. % to about 0.1 wt. %, from about 0.07 wt. % to about 0.1 wt. %, from about 0.08 wt. % to about 0.1 wt. %, from about 0.09 wt. % to about 0.1 wt. %, from about 0.01 wt. % to about 0.09 wt. %, from about 0.02 wt. % to about 0.09 wt. %, from about 0.03 wt. % to about 0.09 wt. %, from about 0.04 wt. % to about 0.09 wt. %, from about 0.05 wt. % to about 0.09 wt. %, from about 0.06 wt. % to about 0.09 wt. %, from about 0.07 wt. % to about 0.09 wt. %, from about 0.08 wt. % to about 0.09 wt. %, from about 0.01 wt. % to about 0.08 wt. %, from about 0.02 wt. % to about 0.08 wt. %, from about 0.03 wt. % to about 0.08 wt. %, from about 0.04 wt. % to about 0.08 wt. %, from about 0.05 wt. % to about 0.08 wt. %, from about 0.06 wt. % to about 0.08 wt. %, from about 0.07 wt. % to about 0.08 wt. %, from about 0.01 wt. % to about 0.07 wt. %, from about 0.02 wt. % to about 0.07 wt. %, from about 0.03 wt. % to about 0.07 wt. % from about 0.04 wt. % to about 0.07 wt. %, from about 0.05 wt. % to about 0.07 wt. %, or from about 0.06 wt. % to about 0.07 wt. %) may be added. For example, the 13Cr material may include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, or 0.1 wt. % Nb.

In some examples, no more than 0.1 wt. % V (e.g., from about 0.01 wt. % to about 0.1 wt. %, from about 0.02 wt. % to about 0.1 wt. %, from about 0.03 wt. % to about 0.1 wt. %, from about 0.04 wt. % to about 0.1 wt. %, from about 0.05 wt. % to about 0.1 wt. %, from about 0.06 wt. % to about 0.1 wt. %, from about 0.07 wt. % to about 0.1 wt. %, from about 0.08 wt. % to about 0.1 wt. %, from about 0.09 wt. % to about 0.1 wt. %, from about 0.01 wt. % to about 0.09 wt. %, from about 0.02 wt. % to about 0.09 wt. %, from about 0.03 wt. % to about 0.09 wt. %, from about 0.04 wt. % to about 0.09 wt. %, from about 0.05 wt. % to about 0.09 wt. %, from about 0.06 wt. % to about 0.09 wt. %, from about 0.07 wt. % to about 0.09 wt. %, from about 0.08 wt. % to about 0.09 wt. %, from about 0.01 wt. % to about 0.08 wt. %, from about 0.02 wt. % to about 0.08 wt. %, from about 0.03 wt. % to about 0.08 wt. %, from about 0.04 wt. % to about 0.08 wt. %, from about 0.05 wt. % to about 0.08 wt. %, from about 0.06 wt. % to about 0.08 wt. %, from about 0.07 wt. % to about 0.08 wt. %, from about 0.01 wt. % to about 0.07 wt. %, from about 0.02 wt. % to about 0.07 wt. %, from about 0.03 wt. % to about 0.07 wt. % from about 0.04 wt. % to about 0.07 wt. %, from about 0.05 wt. % to about 0.07 wt. %, or from about 0.06 wt. % to about 0.07 wt. %) may be added. For example, the 13Cr material may include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, or 0.1 wt. % V.

Optionally, additional elements may be added to the 13Cr material. In one particular embodiment, no more than 0.020 wt. % S, no more than 0.020 wt. % P, no more than 0.25 wt. % Cu, between 0.01 wt. % and 1.0 wt. % Mn, between 0.01 wt. % and 1.0 wt. % Si, and no more than 0.25 wt. % C can be added to a 13Cr material that includes Mo, W, Ti, Nb, V, at least 11 wt. % Cr, and between 0.01 wt. % and 0.5 wt. % Ni. In some examples, such an embodiment may not include an intentional addition of N.

Exemplary ranges of S present in such an embodiment can include from about 0.001 wt. % to about 0.020 wt. %, from about 0.005 wt. % to about 0.020 wt. %, from about 0.010 wt. % to about 0.020 wt. %, from about 0.015 wt. % to about 0.020 wt. %, from about 0.001 wt. % to about 0.015 wt. %, from about 0.005 wt. % to about 0.015 wt. %, from about 0.010 wt. % to about 0.015 wt. %, from about 0.001 wt. % to about 0.010 wt. %, from about 0.005 wt. % to about 0.010 wt. %, or from about 0.001 wt. % to about 0.005 wt. %. Exemplary percentages of S present in such an embodiment can include 0.001 wt. %, 0.002 wt. %, 0.003 wt. %, 0.004 wt. %, 0.005 wt. %, 0.006 wt. %, 0.007 wt. %, 0.008 wt. %, 0.009 wt. %, 0.01 wt. %, 0.011 wt. %, 0.012 wt. %, 0.013 wt. %, 0.014 wt. %, 0.015 wt. %, 0.016 wt. %, 0.017 wt. %, 0.018 wt. %, 0.019 wt. %, or 0.020 wt. %.

Exemplary ranges of P present in such an embodiment can include from about 0.001 wt. % to about 0.020 wt. %, from about 0.005 wt. % to about 0.020 wt. %, from about 0.010 wt. % to about 0.020 wt. %, from about 0.015 wt. % to about 0.020 wt. %, from about 0.001 wt. % to about 0.015 wt. %, from about 0.005 wt. % to about 0.015 wt. %, from about 0.010 wt. % to about 0.015 wt. %, from about 0.001 wt. % to about 0.010 wt. %, from about 0.005 wt. % to about 0.010 wt. %, or from about 0.001 wt. % to about 0.005 wt. %. Exemplary percentages of P present in such an embodiment can include 0.001 wt. %, 0.002 wt. %, 0.003 wt. %, 0.004 wt. %, 0.005 wt. %, 0.006 wt. %, 0.007 wt. %, 0.008 wt. %, 0.009 wt. %, 0.01 wt. %, 0.011 wt. %, 0.012 wt. %, 0.013 wt. %, 0.014 wt. %, 0.015 wt. %, 0.016 wt. %, 0.017 wt. %, 0.018 wt. %, 0.019 wt. %, or 0.020 wt. %.

Exemplary ranges of Cu present in such an embodiment can include from about 0.01 wt. % to about 0.25 wt. %, from about 0.05 wt. % to about 0.25 wt. %, from about 0.10 wt. % to about 0.25 wt. %, from about 0.15 wt. % to about 0.25 wt. %, from about 0.20 wt. % to about 0.25 wt. %, from about 0.01 wt. % to about 0.20 wt. %, from about 0.05 wt. % to about 0.20 wt. %, from about 0.10 wt. % to about 0.20 wt. %, from about 0.15 wt. % to about 0.20 wt. %, from about 0.01 wt. % to 0.15 wt. %, from about 0.05 wt. % to 0.15 wt. %, from about 0.10 wt. % to 0.15 wt. %, from about 0.01 wt. % to about 0.10 wt. %, or from about 0.05 to about 0.10 wt. %. Exemplary percentages of Cu present in such an embodiment can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, or 0.25 wt. %.

Exemplary ranges of Mn present in such an embodiment can include from about 0.01 wt. % to about 1.0 wt. %, from about 0.10 wt. % to about 1.0 wt. %, from about 0.20 wt. % to about 1.0 wt. %, from about 0.30 wt. % to about 1.0 wt. %, from about 0.40 wt. % to about 1.0 wt. %, from about 0.50 wt. % to about 1.0 wt. %, from about 0.60 wt. % to about 1.0 wt. %, from about 0.70 wt. % to about 1.0 wt. %, from about 0.80 wt. % to about 1.0 wt. %, from about 0.90 wt. % to about 1.0 wt. %, from about 0.01 wt. % to about 0.9 wt. %, from about 0.10 wt. % to about 0.9 wt. %, from about 0.20 wt. % to about 0.9 wt. %, from about 0.30 wt. % to about 0.9 wt. %, from about 0.40 wt. % to about 0.9 wt. %, from about 0.50 wt. % to about 0.9 wt. %, from about 0.60 wt. % to about 0.9 wt. %, from about 0.70 wt. % to about 0.9 wt. %, from about 0.80 wt. % to about 0.9 wt. %, from about 0.01 wt. % to about 0.8 wt. %, from about 0.10 wt. % to about 0.8 wt. %, from about 0.20 wt. % to about 0.8 wt. %, from about 0.30 wt. % to about 0.8 wt. %, from about 0.40 wt. % to about 0.8 wt. %, from about 0.50 wt. % to about 0.8 wt. %, from about 0.60 wt. % to about 0.8 wt. %, from about 0.70 wt. % to about 0.8 wt. %, from about 0.01 wt. % to about 0.7 wt. %, from about 0.10 wt. % to about 0.7 wt. %, from about 0.20 wt. % to about 0.7 wt. %, from about 0.30 wt. % to about 0.7 wt. %, from about 0.40 wt. % to about 0.7 wt. %, from about 0.50 wt. % to about 0.7 wt. %, or from about 0.60 wt. % to about 0.7 wt. %. Exemplary percentages of Mn present in such an embodiment can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.30 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.50 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.60 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.70 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.80 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.90 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, or 1.0 wt. %.

Exemplary ranges of Si present in such an embodiment can include from about 0.01 wt. % to about 1.0 wt. %, from about 0.10 wt. % to about 1.0 wt. %, from about 0.20 wt. % to about 1.0 wt. %, from about 0.30 wt. % to about 1.0 wt. %, from about 0.40 wt. % to about 1.0 wt. %, from about 0.50 wt. % to about 1.0 wt. %, from about 0.60 wt. % to about 1.0 wt. %, from about 0.70 wt. % to about 1.0 wt. %, from about 0.80 wt. % to about 1.0 wt. %, from about 0.90 wt. % to about 1.0 wt. %, from about 0.01 wt. % to about 0.9 wt. %, from about 0.10 wt. % to about 0.9 wt. %, from about 0.20 wt. % to about 0.9 wt. %, from about 0.30 wt. % to about 0.9 wt. %, from about 0.40 wt. % to about 0.9 wt. %, from about 0.50 wt. % to about 0.9 wt. %, from about 0.60 wt. % to about 0.9 wt. %, from about 0.70 wt. % to about 0.9 wt. %, from about 0.80 wt. % to about 0.9 wt. %, from about 0.01 wt. % to about 0.8 wt. %, from about 0.10 wt. % to about 0.8 wt. %, from about 0.20 wt. % to about 0.8 wt. %, from about 0.30 wt. % to about 0.8 wt. %, from about 0.40 wt. % to about 0.8 wt. %, from about 0.50 wt. % to about 0.8 wt. %, from about 0.60 wt. % to about 0.8 wt. %, from about 0.70 wt. % to about 0.8 wt. %, from about 0.01 wt. % to about 0.7 wt. %, from about 0.10 wt. % to about 0.7 wt. %, from about 0.20 wt. % to about 0.7 wt. %, from about 0.30 wt. % to about 0.7 wt. %, from about 0.40 wt. % to about 0.7 wt. %, from about 0.50 wt. % to about 0.7 wt. %, or from about 0.60 wt. % to about 0.7 wt. %. Exemplary percentages of Si present in such an embodiment can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.30 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.50 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.60 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.70 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.80 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.90 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, or 1.0 wt. %.

Exemplary ranges of C present in such an embodiment can include from about 0.01 wt. % to about 0.25 wt. %, from about 0.05 wt. % to about 0.25 wt. %, from about 0.10 wt. % to about 0.25 wt. %, from about 0.15 wt. % to about 0.25 wt. %, from about 0.20 wt. % to about 0.25 wt. %, from about 0.01 wt. % to about 0.20 wt. %, from about 0.05 wt. % to about 0.20 wt. %, from about 0.10 wt. % to about 0.20 wt. %, from about 0.15 wt. % to about 0.20 wt. %, from about 0.01 wt. % to 0.15 wt. %, from about 0.05 wt. % to 0.15 wt. %, from about 0.10 wt. % to 0.15 wt. %, from about 0.01 wt. % to about 0.10 wt. %, or from about 0.05 to about 0.10 wt. %. Exemplary percentages of C present in such an embodiment can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, or 0.25 wt. %.

In another particular embodiment, no more than 0.5 wt. % C, no more than 0.040 wt. % S, and no more than 0.040 wt. % P can be added to a 13Cr material that includes Mo, W, Ti, Nb, V, at least 11 wt. % Cr, and between 0.01 wt. % and 1% Ni. Exemplary ranges of C present in such an embodiment can include from about 0.05 wt. % to about 0.5 wt. %, from about 0.10 wt. % to about 0.5 wt. %, from about 0.15 wt. % to about 0.5 wt. %, from about 0.20 wt. % to about 0.5 wt. %, from about 0.25 wt. % to about 0.5 wt. %, from about 0.30 wt. % to about 0.5 wt. %, from about 0.35 wt. % to about 0.5 wt. %, from about 0.40 wt. % to about 0.5 wt. %, from about 0.45 wt. % to about 0.5 wt. %, from about 0.01 wt. % to about 0.4 wt. %, from about 0.05 wt. % to about 0.4 wt. %, from about 0.10 wt. % to about 0.4 wt. %, from about 0.15 wt. % to about 0.4 wt. %, from about 0.20 wt. % to about 0.4 wt. %, from about 0.25 wt. % to about 0.4 wt. %, from about 0.30 wt. % to about 0.4 wt. %, from about 0.35 wt. % to about 0.4 wt. %, from about 0.01 wt. % to about 0.3 wt. %, from about 0.05 to about 0.3 wt. %, from about 0.10 to about 0.3 wt. %, from about 0.15 to about 0.3 wt. %, from about 0.20 to about 0.3 wt. %, from about 0.25 to about 0.3 wt. %, from about 0.01 wt. % to about 0.2 wt. %, from about 0.05 wt. % to about 0.2 wt. %, from about 0.10 wt. % to about 0.2 wt. %, from about 0.15 wt. % to about 0.2 wt. %, from about 0.01 wt. % to about 0.1 wt. %, or from about 0.05 wt. % to about 0.1 wt. % Exemplary percentages of C present in such an embodiment can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.30 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, or 0.50 wt. %.

Exemplary ranges of S present in such an embodiment can include from about 0.0001 wt. % to about 0.040 wt. %, from about 0.001 wt. % to about 0.040 wt. %, from about 0.010 wt. % to about 0.040 wt. %, from about 0.015 wt. % to about 0.020 wt. %, from about 0.025 wt. % to about 0.040 wt. %, from about 0.030 wt. % to about 0.040 wt. %, from about 0.035 wt. % to about 0.040 wt. %, from about 0.0001 wt. % to about 0.035 wt. %, from about 0.001 wt. % to about 0.035 wt. %, from about 0.010 wt. % to about 0.035 wt. %, from about 0.015 wt. % to about 0.035 wt. %, from about 0.020 wt. % to about 0.035 wt. %, from about 0.025 wt. % to about 0.035 wt. %, from ab out 0.030 wt. % to about 0.035 wt. %, from about 0.0001 wt. % to about 0.030 wt. %, from about 0.001 wt. % to about 0.030 wt. %, from about 0.010 wt. % to about 0.030 wt. %, from about 0.015 wt. % to about 0.020 wt. %, from about 0.025 wt. % to about 0.030 wt. %, from about 0.0001 wt. % to about 0.0025 wt. %, from about 0.001 wt. % to about 0.0025 wt. %, from about 0.01 wt. % to about 0.0025 wt. %, from about 0.015 wt. % to about 0.0025 wt. %, from about 0.020 wt. % to about 0.0025 wt. %, from about 0.0001 wt. % to about 0.0020 wt. %, from about 0.001 wt. % to about 0.0020 wt. %, from about 0.01 wt. % to about 0.0020 wt. %, from about 0.015 wt. % to about 0.0020 wt. %, from about 0.0001 wt. % to about 0.015 wt. %, from about 0.001 wt. % to about 0.015 wt. %, from about 0.01 wt. % to about 0.015 wt. %, from about 0.0001 wt. % to about 0.010 wt. %, or from about 0.001 wt. % to about 0.010 wt. %. Exemplary percentages of S present in such an embodiment can include 0.0001 wt. %, 0.0002 wt. %, 0.0003 wt. %, 0.0004 wt. %, 0.0005 wt. %, 0.0006 wt. %, 0.0007 wt. %, 0.0008 wt. %, 0.0009 wt. %, 0.01 wt. %, 0.011 wt. %, 0.012 wt. %, 0.013 wt. %, 0.14 wt. %, 0.015 wt. %, 0.016 wt. %, 0.017 wt. %, 0.018 wt. %, 0.019 wt. %, 0.020 wt. %, 0.021 wt. %, 0.022 wt. %, 0.023 wt. %, 0.024 wt. %, 0.025 wt. %, 0.026 wt. %, 0.027 wt. %, 0.028 wt. %, 0.029 wt. %, 0.030 wt. %, 0.031 wt. %, 0.032 wt. %, 0.033 wt. %, 0.034 wt. %, 0.035 wt. %, 0.036 wt. %, 0.037 wt. %, 0.038 wt. %, 0.039 wt. %, or 0.040 wt. %.

Exemplary ranges of P present in such an embodiment can include from about 0.0001 wt. % to about 0.040 wt. %, from about 0.001 wt. % to about 0.040 wt. %, from about 0.010 wt. % to about 0.040 wt. %, from about 0.015 wt. % to about 0.020 wt. %, from about 0.025 wt. % to about 0.040 wt. %, from about 0.030 wt. % to about 0.040 wt. %, from about 0.035 wt. % to about 0.040 wt. %, from about 0.0001 wt. % to about 0.035 wt. %, from about 0.001 wt. % to about 0.035 wt. %, from about 0.010 wt. % to about 0.035 wt. %, from about 0.015 wt. % to about 0.035 wt. %, from about 0.020 wt. % to about 0.035 wt. %, from about 0.025 wt. % to about 0.035 wt. %, from ab out 0.030 wt. % to about 0.035 wt. %, from about 0.0001 wt. % to about 0.030 wt. %, from about 0.001 wt. % to about 0.030 wt. %, from about 0.010 wt. % to about 0.030 wt. %, from about 0.015 wt. % to about 0.020 wt. %, from about 0.025 wt. % to about 0.030 wt. %, from about 0.0001 wt. % to about 0.0025 wt. %, from about 0.001 wt. % to about 0.0025 wt. %, from about 0.01 wt. % to about 0.0025 wt. %, from about 0.015 wt. % to about 0.0025 wt. %, from about 0.020 wt. % to about 0.0025 wt. %, from about 0.0001 wt. % to about 0.0020 wt. %, from about 0.001 wt. % to about 0.0020 wt. %, from about 0.01 wt. % to about 0.0020 wt. %, from about 0.015 wt. % to about 0.0020 wt. %, from about 0.0001 wt. % to about 0.015 wt. %, from about 0.001 wt. % to about 0.015 wt. %, from about 0.01 wt. % to about 0.015 wt. %, from about 0.0001 wt. % to about 0.010 wt. %, or from about 0.001 wt. % to about 0.010 wt. %. Exemplary percentages of P present in such an embodiment can include 0.0001 wt. %, 0.0002 wt. %, 0.0003 wt. %, 0.0004 wt. %, 0.0005 wt. %, 0.0006 wt. %, 0.0007 wt. %, 0.0008 wt. %, 0.0009 wt. %, 0.01 wt. %, 0.011 wt. %, 0.012 wt. %, 0.013 wt. %, 0.14 wt. %, 0.015 wt. %, 0.016 wt. %, 0.017 wt. %, 0.018 wt. %, 0.019 wt. %, 0.020 wt. %, 0.021 wt. %, 0.022 wt. %, 0.023 wt. %, 0.024 wt. %, 0.025 wt. %, 0.026 wt. %, 0.027 wt. %, 0.028 wt. %, 0.029 wt. %, 0.030 wt. %, 0.031 wt. %, 0.032 wt. %, 0.033 wt. %, 0.034 wt. %, 0.035 wt. %, 0.036 wt. %, 0.037 wt. %, 0.038 wt. %, 0.039 wt. %, or 0.040 wt. %.

Figure 3:
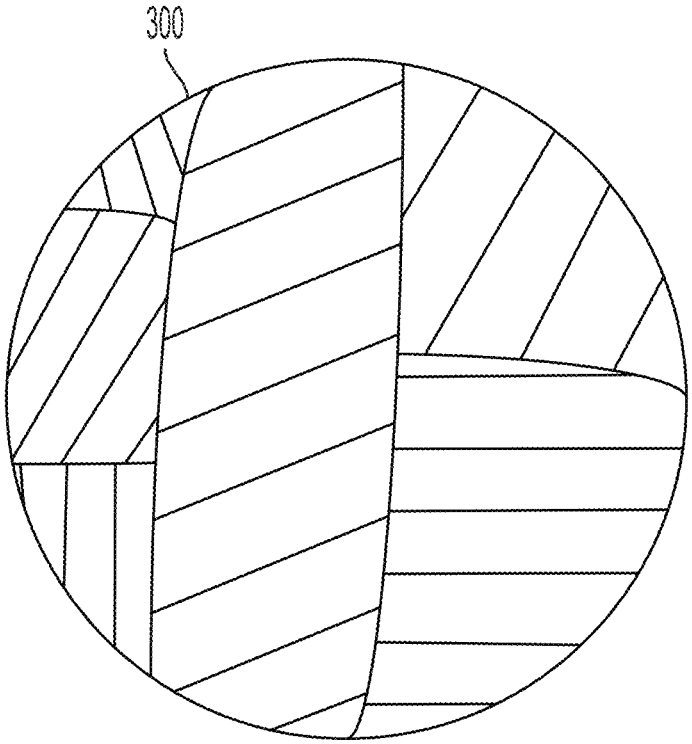
FIG. 3 is a diagram of a microstructure of a 13Cr material according to one example of the present disclosure.

At block 206, a treatment can be performed on the 13Cr material. The treatment may include one or more cycles of austenitizing, quenching, heat tempering, or annealing treatments. In some examples, the quench treatment may be a deep freeze treatment. The treatment can increase the hardness of the 13Cr material, such as to strengths of 95/100/105/110/115/120/125 ksi MY. Additionally, the treatment can increase the toughness of the 13Cr material, such that the material has an increased resistance to hydrogen stress cracking and sulfide stress cracking. Despite the austenizating treatment, due the relatively low nickel content and the presence of additional elements such as Mo, W, Ti, Nb, and V the microstructure of the 13Cr material can remain primarily martensitic. This can be seen in the exemplary diagram of FIG. 3, which shows the martensitic microstructure of an 13Cr material 300 that has been improved according to one example of the present disclosure.

In the particular embodiment where the 13Cr material includes at least 11 wt. % Cr, between 0.01 wt. % and 0.5 wt. % Ni, between 0.001 wt. % and 0.020 wt. % S, between 0.001 wt. % and 0.020 wt. % P, between 0.01 wt. % and 0.25 wt. % Cu, between 0.01 wt. % and 1.0 wt. % Mn, between 0.01 wt. % and 1.0 wt. % Si, between 0.01 wt. % and 0.25 wt. % C, Mo, W, Ti, Nb, and V, the treatment may involve an austenitizing treatment, a quench treatment, and a heat tempering treatment. Alternatively, the treatment may involve an austenitizing treatment, a quench treatment, a further austenitizing treatment, a further quench treatment, and a heat tempering treatment. Such a treatment may produce a 13Cr material exhibiting a strength between 95 and 125 ksi MY, and a primarily martensitic microstructure exhibiting very little austenite phases or ferrite phases after a final heat temping treatment.

In the particular embodiment where the 13Cr material includes at least 11 wt. % Cr, between 0.1 wt. % and 1.0 wt. % Ni, between 0.01 wt. % and 0.5 wt. % C, between 0.001 wt. % and 0.040 wt. % S, between 0.001 wt. % and 0.040 wt. % P, Mo, W, Ti, Nb, and V, the treatment may involve annealing treatments and heat tempering treatments, in some cases with or without quenching treatments as well. One or more of the quenching treatments may be a deep freeze treatment. Alternatively or additionally, the treatment may involve at least two quenching treatments and at least two heat tempering treatments. Such a treatment may produce a 13Cr material exhibiting a strength of 80 ksi MY or lower. Additional processes, such as additive manufacturing, may be employed to achieve the desired microstructure exhibiting primarily martensitic characteristics.

In some examples, the 13Cr material may exhibit a tensile strength of from 110 ksi to 140 ksi (e.g., from about 115 ksi to about 140 ksi, from about 120 ksi to about 140 ksi, from about 125 ksi to about 140 ksi, from about 130 ksi to about 140 ksi, from about 135 ksi to about 140 ksi, from about 110 ksi to about 135 ksi, from about 115 ksi to about 135 ksi, from about 120 ksi to about 135 ksi, from about 125 ksi to about 135 ksi, from about 130 ksi to about 135 ksi, from about 110 ksi to about 130 ksi, from about 115 ksi to about 130 ksi, from about 120 ksi to about 130 ksi, from about 125 ksi to about 130 ksi, from about 110 ksi to about 125 ksi, from about 115 ksi to about 125 ksi, from about 120 ksi to about 125 ksi, from about 110 ksi to about 120 ksi, from about 115 ksi to about 120 ksi, or from about 110 ksi to about 115 ksi). Examples of tensile strengths can include110 ksi, 111 ksi, 112 ksi, 113 ksi, 114 ksi, 115 ksi, 116 ksi, 117 ksi, 118 ksi, 119 ksi, 120 ksi, 121 ksi, 122 ksi, 123 ksi, 124 ksi, 125 ksi, 126 ksi, 127 ksi, 128 ksi, 129 ksi, 130 ksi, 131 ksi, 132 ksi, 133 ksi, 134 ksi, 135 ksi, 136 ksi, 137 ksi, 138 ksi, 139 ksi, or 140 ksi.

In some examples, after undergoing a Charpy V-notch impact test, the 13Cr material may exhibit a Charpy impact value of from 20 J to 40 J (e.g., from about 25 J to about 40 J, from about 30 J to about 40 J, from about 35 J to about 40 J, from about 20 J to about 35 J, from about 25 J to about 35 J, from about 30 J to about 35 J, from about 20 J to about 30 J, from about 25 J to about 30 J, or from about 20 J to about 25 J) at 0° C. Examples of the Charpy impact value can include from 20 J, 21 J, 22 J, 23 J, 24 J, 25 J, 26 J, 27 J, 28 J, 29 J, 30 J, 31 J, 32 J, 33 J, 34 J, 35 J, 36 J, 38 J, 39 J, or 40 J.

In some examples, the percentage of elongation from the original length of the 13Cr material to the point of failure can be from 10% to 20% (e.g., from about 12% to about 20%, from about 14% to about 20%, from about 16% to about 20%, from about 18% to about 20%, from about 10% to about 19%, from about 12% to about 19%, from about 14% to about 19%, from about 16% to about 19%, from about 18% to about 19%, from about 10% to about 18%, from about 12% to about 18%, from about 14% to about 18%, from about 16% to about 18%, from about 10% to about 17%, from about 12% to about 17%, from about 14% to about 17%, from about 16% to about 17%, from about 10% to about 16%, from about 12% to about 16%, from about 14% to about 16%, from about 10% to about 15%, from about 12% to about 15%, from about 14% to about 15%, from about 10% to about 14%, from about 12% to about 14%, from about 10% to about 13%, from about 12% to about 13%, or from about 10% to about 12%. Examples of the elongation percentage can include 10%, 11%, 12%, 13%, 14%, 15%, 16%, 17%, 18%, 19%, or 20%.

Aspects of the invention may be further understood by reference to the following non-limiting examples.

EXAMPLE

High Strength Stainless Steel Material with Low Nickel According to Aspects of the Present Disclosure Compared to Super 13Cr Stainless Steel Material with High Nickel The following experiment shows the characteristics of three low-nickel (LN-1, LN-2, LN-3) 13Cr materials improved with composition and treatment, according to aspects of the present disclosure, to allow for increased toughness and SSC resistance. The composition of each of LN-1, LN-2, and LN-3 is depicted in Table 1.

TABLE 1

Chemistry Details.

| | LN-1 | LN-2 | LN-3 |
|---|---|---|---|
| % C | 0.2 | 0.188 | 0.19 |
| % Mn | 0.86 | 0.84 | 0.73 |
| % Si | 0.44 | 0.40 | 0.26 |
| % P | 0.019 | 0.014 | 0.011 |
| % S | 0.002 | 0.007 | 0.0022 |
| % Cr | 13.25 | 13.20 | 13.18 |
| % Ni | 0.13 | 0.13 | 0.14 |
| % Mo | 0.04 | ND | 0.03 |
| % Cu | 0.05 | 0.06 | 0.06 |
| % Nb (Cb) | 0.04 | ND | ND |
| % Ti | 0.004 | ND | <0.01 |
| % V | ND | ND | ND |

LN-1, LN-2, and LN-3 were then treated with a first austenitizing treatment, a quenching treatment, a second austenitizing treatment, a second quenching treatment, and a heat tempering treatment as outlined in Table 2 to achieve yield strengths of at least 95 ksi.

TABLE 2

Treatment Details.

| | 1st Austenitizing Details | 2nd Austenitizing Details | Tempering Details |
|---|---|---|---|
| LN-1 | 1828° F. (998° C.) for 3 hours, Oil Quench | 1706° F. (930° C.) for 3 hours, Polymer Quench | 1130° F. (610° C.) for 4 hours and 45 minutes, Air cool |
| LN-2 | 1832° F. (1000° C.) for 4 hours, Oil Quench | 1652° F. (900° C.) for 4 hours, Oil Quench | 1130° F. (610° C.) for 6 hours, Air cool |
| LN-3 | 1825° F. (996° C.) for 3 hours, Air Quench | 1675° F. (913° C.) for 3 hours, Oil Quench | 1095° F. (591° C.) for 5 hours, Air cool |

The resulting improved LN-1, LN-2, and LN-3 materials were then tested on their tensile properties, Charpy V-notch Impact Properties, and SSC resistivity, as depicted in Table 3, Table 4, and Table 5, respectively.

TABLE 3

Tensile Property Details.

| | Yield Strength, ksi | Tensile Strength, ksi | % Elongation | % Reduction of Area |
|---|---|---|---|---|
| LN-1 | 119.1 | 136.4 | 15.8 | 58 |
| LN-2 | 101.1 | 117.9 | 18.8 | 67 |
| LN-3 | 114.1 | 132.3 | 17.0 | 55 |

TABLE 4

Charpy V-notch Impact Properties.

| | Test Temperature | Average Charpy Impact |
|---|---|---|
| LN-1 | 32° F. (0° C.) | 25 ft-lbs (34 Joules) |
| LN-2 | 32° F. (0° C.) | 17 ft-lbs (23 Joules) |
| LN-3 | 32° F. (0° C.) | 19 ft-lbs (26 Joules) |

TABLE 5

Sulfide Stress Cracking (SSC) Test Data.

| | Test Temperature | H2S (psi) | Chloride, mg/l | pH | % Stress | Results |
|---|---|---|---|---|---|---|
| LN-1 | RT | 14.5 | 140000 | 4.5 | 90% AYS | Pass |
| LN-2 | RT | 14.5 | 140000 | 4.5 | 90% AYS | Pass |
| LN-3 | RT | 14.5 | 140000 | 4.5 | 90% AYS | Pass |

Additionally, a further control experiment was conducted to demonstrate the characteristics of three high-nickel (HN-1, HN-2, HN-3) Super 13Cr materials. The composition of each of HN-1, HN-2, and HN-3 is depicted in Table 6.

TABLE 6

Chemistry Details.

| | HN-1 | HN-2 | HN-3 |
|---|---|---|---|
| % C | 0.22 | 0.19 | 0.019 |
| % Mn | 0.77 | 0.23 | 0.55 |
| % Si | 0.30 | 0.35 | 0.21 |
| % P | 0.018 | 0.012 | 0.016 |
| % S | 0.0007 | 0.0022 | 0.0004 |
| % Cr | 13.37 | 12.22 | 12.53 |
| % Ni | 4.79 | 5.37 | 5.54 |
| % Mo | 1.63 | 1.93 | 1.72 |
| % Cu | 0.08 | 0.08 | 0.059 |
| % Nb (Cb) | ND | ND | 0.043 |
| % Ti | <0.15 | <0.01 | 0.004 |
| % V | <0.10 | 0.18 | 0.031 |
| % N | 0.08 | 0.018 | 0.061 |

HN-1, HN-2, and HN-3 were then treated with a austenitizing treatment, a quenching treatment, a first heat tempering treatment, and in some cases a second heat tempering treatment as outlined in Table 7 to achieve yield strengths of at least 95 ksi.

TABLE 7

Treatment Details.

| | Austenitizing Details | Tempering Details | 2nd Tempering Details |
|---|---|---|---|
| HN-1 | 1710° F. (932° C.) for 4 hours and 40 minutes, Air | 1148° F. (620° C.) for 14 hours, Air Cool | NA |

TABLE 7-continued

| Treatment Details. | | | |
|---|---|---|---|
| | Austenitizing Details | Tempering Details | 2nd Tempering Details |
| | Quench | | |
| HN-2 | 1742° F. (950° C.) for 2 hours and 3 minutes, Oil Quench | 1148° F. (620° C.) for 5 hours and 4 minutes, Air Cool | 1022° F. (550° C.) for 2 hours, Air Cool |
| HN-3 | 1796° F. (980° C.) for 5 hours, Air Quench | 1112° F. (600° C.) for 10 hours, Air Cool | NA |

The resulting HN-1, HN-2, and HN-3 materials were then tested on their tensile properties, Charpy V-notch Impact Properties, and SSC resistivity, as depicted in Table 8, Table 9, and Table 10, respectively.

TABLE 8

| Tensile Property Details. | | | | |
|---|---|---|---|---|
| | Yield Strength, ksi | Tensile Strength, ksi | % Elongation | % Reduction of Area |
| HN-1 | 100.0 | 130.0 | 20.0 | 53 |
| HN-2 | 108.0 | 129.0 | 22.5 | 66 |
| HN-3 | 125.0 | 140.0 | 21.0 | 60 |

TABLE 9

| Charpy V-notch Impact Properties. | | |
|---|---|---|
| | Test Temperature | Average Charpy Impact |
| HN-1 | 14° F. (−10° C.) | 109 ft-lbs (148 Joules) |
| HN-2 | 14° F. (−10° C.) | 139 ft-lbs (189 Joules) |
| HN-3 | 14° F. (−10° C.) | 137 ft-lbs (186 Joules) |

TABLE 10

| Sulfide Stress Cracking (SSC) Test Data. | | | | | | |
|---|---|---|---|---|---|---|
| | Test Temperature | H2S (psi) | Chloride, mg/l | pH | % Stress | Results |
| HN-1 | RT | 0.3 | 140000 | 4.5 | 90% AYS | Pass |
| HN-2 | RT | 0.3 | 140000 | 4.5 | 90% AYS | Pass |
| HN-1 | RT | 0.45 | 140000 | 4.5 | 90% AYS | Fail |
| HN-2 | RT | 0.45 | 140000 | 4.5 | 90% AYS | Fail |
| HN-1 | RT | 0.45 | 66000 | 4.5 | 90% AYS | Fail |
| HN-2 | RT | 0.45 | 66000 | 4.5 | 90% AYS | Fail |
| HN-3 | RT | 0.15 | 140000 | 4.5 | 90% AYS | Pass |
| HN-3 | RT | 0.73 | 140000 | 5.5 | 90% AYS | Fail |

Table 3 provides actual room temperature tensile properties with two low-nickel 13Cr materials over 110 ksi yield strength and one low-nickel 13Cr material over 95 ksi yield strength. This is compared to Table 8, showing all high-nickel Super 13Cr materials over 95 ksi yield strength and one high-nickel Super 13Cr material over 110 ksi yield strength. Thus, overall the low-nickel 13Cr materials have slightly lower ductility (via the percent elongation) as compared to high-nickel Super 13Cr materials.

Table 4 provides Charpy impact toughness data for the low-nickel 13Cr materials according to aspects of the present disclosure, which can be compared with Table 9 for the high-nickel Super 13Cr materials. It is to be noted that lower testing temperatures can increase the severity of the test, but overall testing at 32° F. (0° C.) and 14° F. (−10° C.) can be within 2-3 ft-lbs with testing at 14° F. (−10° C.) leading to lower values compared to 32° F. (0° C.). Comparing the two sets of data (Table 4 vs Table 9), the low-nickel 13Cr materials according to aspects of the present disclosure have lower toughness compared to the high-nickel Super 13Cr materials.

Table 5 provides Sulfide Stress Cracking (SSC) test data results for the low-nickel 13Cr materials according to aspects of the present disclosure compared with Table 10 for the high-nickel Super 13Cr materials. All testing was done at room temperature (RT) and these systems may have higher vulnerability to SSC at lower temperatures (close to room temperature) than at higher temperatures. All testing was done at 90% AYS (where AYS stands for actual yield strength of the heat), in line with industry protocol for testing stress to be used for general qualification limits. Higher AYS percentages, lower pH, and higher chloride content can increase the severity of SSC. Based on this, comparing the SSC performance of the low-nickel 13Cr materials to the high-nickel Super 13Cr materials of similar strengths; the low-nickel 13Cr materials show much higher SSC resistance than the high-nickel Super 13Cr materials. Therefore, it is likely that the low-nickel 13Cr materials according to aspects of the present disclosure can more effectively resist SSC in wellbore systems containing higher amounts of $H_2S$, lower pH, and higher chloride contents than the high-nickel Super 13Cr materials.

In some aspects, apparatus and method for high-strength stainless steel materials are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a stainless steel material comprising: at least about 11 wt. % Cr; between about 0.01 wt. % and about 1.0 wt. % Ni; more than 0 wt. % Mo; more than 0 wt. % W; more than 0 wt. % Ti; more than 0 wt. % Nb; and more than 0 wt. % V.

Example 2 is the stainless steel material of example(s) 1, further comprising: no more than about 0.020 wt. % S; no more than about 0.020 wt. % P; no more than about 0.25 wt. % Cu; between about 0.01 wt. % and about 1.0 wt. % Mn; between about 0.01 wt. % and about 1.0 wt. % Si; and no more than about 0.25 wt. % C.

Example 3 is the stainless steel material of example(s) 1-2, further comprising: no more than about 0.5 wt. % C; no more than about 0.040 wt. % S; and no more than about 0.040 wt. % P.

Example 4 is the stainless steel material of example(s) 1-3, wherein the stainless steel material comprises a minimum yield strength of less than 80 ksi.

Example 5 is the stainless steel material of example(s) 1-4, wherein the stainless steel material exhibits a tensile strength of about 110 ksi to about 140 ksi.

Example 6 is the stainless steel material of example(s) 1-5, wherein the stainless steel material exhibits a Charpy impact value of about 20 J to about 40 J at about 0° C.

Example 7 is the stainless steel material of example(s) 1-6, wherein the stainless steel material exhibits an elongation of about 10% to about 20%.

Example 8 is the stainless steel material of example(s) 1-7, further comprising: no more than 0.25 wt. % Mo; no more than 0.1 wt. % W; no more than 0.1 wt. % Ti; no more than 0.1 wt. % Nb; and no more than 0.1 wt. % V.

Example 9 is the stainless steel material of example(s) 1-8, wherein the stainless steel material comprises between 0.01 wt. % and 0.5 wt. % Ni.

Example 10 is the stainless steel material of example(s) 1-9, wherein the stainless steel material comprises a minimum yield strength of from 95 to 125 ksi.

Example 11 is a method of forming a stainless steel material comprising: melting together a material comprising: at least 11 wt. % Cr; and between 0.01 wt. % and 1.0 wt. % Ni; and adding Mo, W, Ti, Nb, and V to the material.

Example 12 is the method of example(s) 11, further comprising: performing at least one quench treatment on the material.

Example 13 is the method of example(s) 11-12, wherein the at least one quench treatment comprises a deep freeze treatment.

Example 14 is the method of example(s) 11-13, further comprising: performing at least one austenitizing treatment on the material.

Example 15 is the method of example(s) 11-14, further comprising: performing at least one heat tempering treatment on the material.

Example 16 is the method of example(s) 11-15, wherein melting together the material further comprises the material further comprising: no more than 0.020 wt. % S; no more than 0.020 wt. % P; no more than 0.25 wt. % Cu; between 0.01 wt. % and 1.0 wt. % Mg; between 0.01 wt. % and 1.0 wt. % Si; and no more than 0.25 wt. % C.

Example 17 is the method of example(s) 11-16, wherein melting together the material further comprises the material further comprising: no more than 0.5 wt. % C; no more than 0.040 wt. % S; and no more than 0.040 wt. % P.

Example 18 is the method of example(s) 11-17, wherein adding Mo, W, Ti, Nb, and V to the material further comprises adding: no more than 0.25 wt. % Mo; no more than 0.1 wt. % W; no more than 0.1 wt. % Ti; no more than 0.1 wt. % Nb; and no more than 0.1 wt. % V.

Example 19 is the method of example(s) 11-18, wherein melting together the material further comprises the material further comprising between 0.01 wt. % and 0.5 wt. % Ni.

Example 20 is the method of example(s) 11-19, wherein the material exhibits a minimum yield strength of from 95 to 125 ksi.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A stainless steel material comprising:

11-14 wt. % Cr, 0.01 wt. %-1.0 wt. % Ni, 0.01-0.25 wt. % Mo, 0.01-0.25 wt. % W, 0.01-0.25 wt. % Ti, 0.01-0.25 wt. % Nb, 0-0.25 wt. % V, 0.001-0.040 wt. % S, 0.001-0.040 wt. % P, 0.01-0.25 wt. % Cu, 0.01-1.0 wt. % Mn, 0.01-1.0 wt. % Si, 0.01-0.5 wt. % C, wherein the stainless steel material exhibits an elongation of from 15% to 20%.

2. The stainless steel material of claim 1, wherein the stainless steel material comprises:

11-14 wt. % Cr, 0.01 wt. %-0.50 wt. % Ni, 0.01-0.25 wt. % Mo, 0.01-0.25 wt. % W, 0.01-0.25 wt. % Ti, 0.01-0.25 wt. % Nb, 0-0.25 wt. % V, 0.001-0.040 wt. % S, 0.001-0.040 wt. % P, 0.01-0.25 wt. % Cu, 0.01-1.0 wt. % Mn, 0.01-1.0 wt. % Si, 0.20-0.5 wt. % C.

3. The stainless steel material of claim 1, wherein the stainless steel material comprises:

11-14 wt. % Cr, 0.01 wt. %-0.50 wt. % Ni, 0.01-0.25 wt. % Mo, 0.01-0.25 wt. % W, 0.01-0.25 wt. % Ti, 0.01-0.045 wt. % Nb, 0-0.25 wt. % V, 0.001-0.020 wt. % S, 0.001-0.020 wt. % P, 0.01-0.25 wt. % Cu, 0.01-1.0 wt. % Mn, 0.01-1.0 wt. % Si, 0.20-0.5 wt. % C.

4. The stainless steel material of claim 1, wherein the stainless steel material comprises a minimum yield strength of 80 ksi to 125 ksi.

5. The stainless steel material of claim 4, wherein the stainless steel material exhibits a tensile strength of 110 ksi to 140 ksi.

6. The stainless steel material of claim 1, wherein the stainless steel material exhibits a Charpy impact value of 20 J to 40 J at 0° C.

7. The stainless steel material of claim 1, wherein the stainless steel material comprises a minimum yield strength of from 95 to 125 ksi.

8. A method of forming the stainless steel material of claim 1 comprising:

melting together a material comprising:

11-14 wt. % Cr, 0.01 wt. %-1.0 wt. % Ni, 0.01-0.25 wt. % Mo, 0.01-0.25 wt. % W, 0.01-0.25 wt. % Ti, 0.01-0.25 wt. % Nb, 0.01-0.25 wt. % V, 0.001-0.040 wt. % S, 0.001-0.040 wt. % P, 0.01-0.25 wt. % Cu, 0.01-1.0 wt. % Mn, 0.01-1.0 wt. % Si, 0.01-0.5 wt. % C, wherein the stainless steel material exhibits an elongation of from 15% to 20%.

9. The method of claim 8, further comprising:

performing at least one quench treatment on the stainless steel material.

10. The method of claim 9, wherein the at least one quench treatment comprises a deep freeze treatment.

11. The method of claim 8, further comprising:

performing at least one austenitizing treatment on the stainless steel material.

12. The method of claim 8, further comprising:

performing at least one heat tempering treatment on the stainless steel material.

13. The method of claim 8, wherein melting together the material comprises:

11-14 wt. % Cr, 0.01 wt. %-0.50 wt. % Ni, 0.01-0.25 wt. % Mo, 0.01-0.25 wt. % W, 0.01-0.25 wt. % Ti, 0.01-0.25 wt. % Nb, 0.01-0.25 wt. % V, 0.001-0.040 wt. % S, 0.001-0.040 wt. % P, 0.01-0.25 wt. % Cu, 0.01-1.0 wt. % Mn, 0.01-1.0 wt. % Si, 0.20-0.5 wt. % C.

14. The method of claim 8, wherein melting together the material comprises:

11-14 wt. % Cr, 0.01 wt. %-0.50 wt. % Ni, 0.01-0.25 wt. % Mo, 0.01-0.25 wt. % W, 0.01-0.25 wt. % Ti, 0.01-0.045 wt. % Nb, 0.01-0.25 wt. % V, 0.001-0.020 wt. % S, 0.001-0.020 wt. % P, 0.01-0.25 wt. % Cu, 0.01-1.0 wt. % Mn, 0.01-1.0 wt. % Si, 0.20-0.5 wt. % C.

15. The method of claim 8, wherein the material exhibits a minimum yield strength of from 95 to 125 ksi.

* * * * *